United States Patent [19]

Nguyen-Thanh

[11] 4,445,568

[45] May 1, 1984

[54] SUPERHEATED STEAM GENERATOR

[75] Inventor: Thong Nguyen-Thanh, Cernay-la-Ville, France

[73] Assignee: Commissariat a l'Energie Atomique, Paris, France

[21] Appl. No.: 358,181

[22] Filed: Mar. 15, 1982

[30] Foreign Application Priority Data

Mar. 20, 1981 [FR] France ..... 81 05643

[51] Int. Cl.[3] ..... F28F 7/00

[52] U.S. Cl. ..... 165/81; 165/134 R; 165/158; 122/32

[58] Field of Search ..... 122/32, 234, 235 C, 122/235 D, 235 E, 249, 363, 365, 473, 476, 483, 486, 508, 512; 165/81, 134 R, 158, 164; 176/65; 376/298, 299, 402, 405

[56] References Cited

U.S. PATENT DOCUMENTS

| | | | |
|---|---|---|---|
| 466,092 | 12/1891 | Edwards | 122/249 |
| 2,102,424 | 12/1937 | Larrecq | 122/32 X |
| 3,596,638 | 8/1971 | Rupprecht | 122/32 |
| 3,768,554 | 10/1973 | Stahl | 122/32 X |
| 3,930,537 | 1/1976 | Wolowodiuk | 122/32 X |
| 4,235,284 | 11/1980 | Coleman | 165/141 |

FOREIGN PATENT DOCUMENTS

| | | | |
|---|---|---|---|
| 2010568 | 2/1970 | France . | |
| 2386798 | 11/1978 | France . | |
| 359716 | 3/1962 | Switzerland . | |
| 800385 | 8/1958 | United Kingdom | 176/65 |

*Primary Examiner*—Albert J. Makay
*Assistant Examiner*—David Helmbold

[57] ABSTRACT

Superheated steam generator comprising an outer ferrule having at its opposite ends a chamber for the intake of water to be vaporized and superheated and a steam outflow chamber and a group of tubes connecting said chambers in which circulates the water to be vaporized and superheated by heat exchange with a hotter fluid circulating in counterflow around the tubes within the outer ferrule, wherein the steam outflow chamber comprises an outer wall surrounded by a coil linked with said chamber, in such a way that part of the superheated steam introduced into the outflow chamber circulates in the coil.

The invention is intended more particularly for use in superheated steam generators by heat exchange with liquid sodium in power stations based on a fast breeder reactor.

3 Claims, 2 Drawing Figures

SUPERHEATED STEAM GENERATOR

BACKGROUND OF THE INVENTION

The present invention relates to a superheated steam generator comprising an outer ferrule having at its opposite ends a chamber for the intake of water to be vapourized and superheated and a steam outflow chamber and a group of tubes connecting said chambers in which circulates the water to be vaporized and superheated by heat exchange with a hotter fluid circulating in counterflow around the tubes within the outer ferrule.

In such a steam generator, the wall of the steam outlet chamber may comprise:

(a) a first part constituted by a thick tube plate with a concave surface on the side of the chamber and an outer annular area, the whole of the first part being obtained by forging a single cylindrical blank, (b) a second hemispherical part constituted by a stamped or forged end connected to the first part by a circumferential weld located in a plane perpendicular to the axis of the steam generator.

Very high temperature and very high pressure superheated steam passes through such steam outlet chambers. They have a steam outlet mounting and one or more inspection holes. The tube plate and bottom, which form their walls, must be very thick. Therefore very high thermal stresses occur during transient operating conditions, on starting, stopping or operation change. These stresses appear in the walls of the chamber due to the delay with which the outer wall thereof follows the temperature variations of the inner wall. They also occur on the periphery of the tube plate, due to the thermal inertia difference between the perforated area of the plate and the unperforated peripheral area. They also occur in the connection area between the chamber enclosure and the steam discharge mounting as a result of their thickness differences, as well as in the connection area of the chamber envelope with the outer ferrule of the exchanger. Particularly in the case of a superheated steam discharge chamber of a heat exchanger between the water to be vaporized and superheated and liquid sodium in an installation for the generation of electric power from a fast breeder reactor, the superheated steam leaves at a pressure of about 200 bars and a temperature of about 500° C. As a result of this pressure and temperature, it is necessary to make the tube plate and chamber bottom very thick. The operating temperature, which is much higher than ambient temperature produces important temperature variations. These give rise to high thermal stresses during transient operating states, so that special precautions must be taken in the operation of such exchangers.

BRIEF SUMMARY OF THE INVENTION

The object of the present invention is to obviate these disadvantages and to make it possible to reduce the thermal stresses on the outer wall and the tube plate surrounding the steam outflow chamber of the generator, whilst preventing inadmissible damage during transient operating states, whilst facilitating the manufacture of the steam generator.

The present invention therefore relates to a superheated steam generator, wherein the steam outflow chamber comprises an outer wall surrounded by a coil linked with said chamber, in such a way that part of the superheated steam introduced into the outflow chamber circulates in the coil.

Preferably the coil issues into a pipe for discharging the superheated steam out of the outflow chamber.

BRIEF DESCRIPTION OF THE DRAWINGS

The invention is described in greater detail hereinafter relative to a non-limitative, but preferred embodiment of the invention and with reference to the attached drawings, wherein show.

DETAILED DESCRIPTION OF THE PREFERRED EMBODIMENTS

Figure 1:
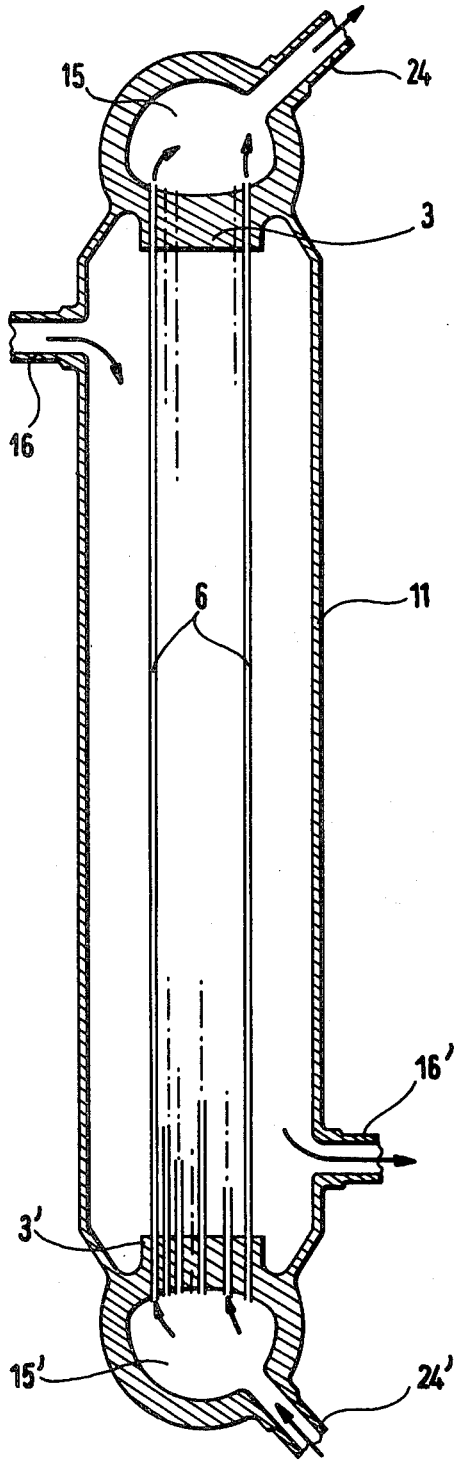
FIG. 1 a diagrammatic sectional view of a superheated steam generator in accordance with the invention.

As is illustrated by FIG. 1, the superheated steam generator according to the invention comprises an outer cylindrical ferrule 11 defining a vertical axis. This ferrule has at its lower end an intake chamber 15' for the water to be vaporized and supplied by a pipe 24', whilst at its upper end it has a superheated steam outflow or discharge chamber 15 connected to a discharge pipe 24. Chambers 15 and 15' are connected by a group of vertical straight tubes 6, which are respectively connected to the intake chamber 15' by a very thick tube plate 3' and to the outflow chamber 15 by a very thick tube plate 3. Thus, the water to be vaporized and superheated circulates from bottom to top in the steam generator tube 6 and is vaporized and superheated by heat exchange with a hotter fluid, which circulates from top to bottom around the tubes and within ferrule 11, between an inlet pipe 16 and an outlet pipe 16'.

Figure 2:
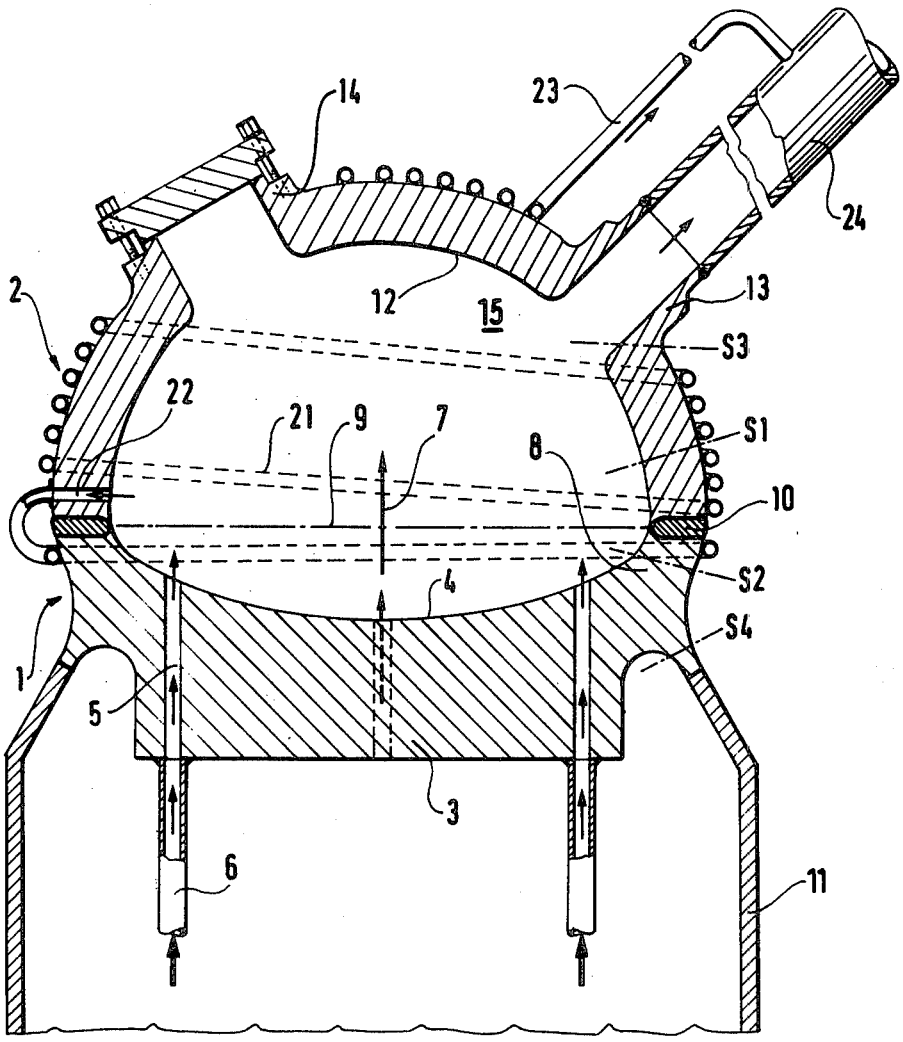
FIG. 2 a larger scale sectional view of the upper part of the steam generator of FIG. 1.

In FIG. 2 it can be seen that the outflow chamber 15 comprises an outer wall in two parts 8 and 2. Part 8 constitutes an annular zone forged from one part 1 with the tube plate 3, the latter having a concave surface 4 on the side of chamber 15. Part 1 is traversed by orifices such as 5 extending the tube 6 of the group of tubes. Arrow 7 indicates the steam circulation direction on leaving these orifices. The annular connection zone 8 is connected on its circumference to the second part 2 of the chamber wall by a weld bead 10 at the reference plane 9 perpendicular to the axis of ferrule 11. Part 1 is also connected by annular zone 8 to the outer ferrule 11 of the generator.

The second part 2 of the wall of chamber 15 having a hemispherical shape and of inner surface 12 is provided with a connection mounting 13 to the steam discharge pipe 24, as well as an inspection hole 14 (other inspection holes may optionally be added).

It is obvious that during changes to the operating conditions, significant thermal stresses occur in section S1 of the wall of chamber 15, due to its considerable thickness, in section S2 of the connection zone between tube plate 3 and weld bead 10, in the connection section S3 of the wall to the steam discharge mounting 13 and in section S4 of the connection zone to the generator outer ferrule 11.

According to the invention, the steam outflow chamber 15 is surrounded by a coil 21, supplied with superheated steam by an orifice 22 in its wall, and connected by a tube 23 to the superheated steam discharge pipe 24. This coil makes it possible to cool or heat the outer wall, depending on whether the temperature of the steam entering the steam outflow chamber decreases or increases, as a function of the operating variations of the steam generator.

The invention is intended more particularly for use in superheated steam generators by heat exchange with liquid sodium in power stations based on a fast breeder reactor.

What is claimed is:

1. A superheated steam generator comprising an outer ferrule having at its opposite ends a chamber for the intake of water to be vaporized and superheated and a steam outflow chamber and a group of tubes connecting said chambers in which circulates the water to be vaporized and superheated by heat exchange with a hotter fluid circulating in counterflow around the tubes within the outer ferrule, wherein the steam outflow chamber comprises an outer wall surrounded by a coil linked with said chamber, in such a way that part of the superheated steam introduced into the outflow chamber circulates in the coil.

2. A steam generator according to claim 1, wherein the coil issues into a pipe for discharging the superheated steam out of the outflow chamber.

3. A steam generator according to claims 1 or 2, wherein the tubes are connected to the outflow chamber by a tube plate having a concave surface on the side of the outflow chamber, and wherein the outer wall comprises an annular area forged in one piece with the tube plate from a cylindrical blank, and a stamped or forged hemispherical part connected to the annular area by a circumferential weld, located in a plane perpendicular to the axis defined by the outer ferrule.

* * * * *